United States Patent [19]

Thornhill

[11] Patent Number: 4,891,856

[45] Date of Patent: Jan. 9, 1990

[54] GRASPING SYSTEM FOR USE WITH A CONTOURED SHEET

[76] Inventor: Maria T. Thornhill, 15 Prospect Dr., Coral Gables, Fla. 33133

[21] Appl. No.: 290,609

[22] Filed: Dec. 27, 1988

[51] Int. Cl.[4] ..... A47G 9/04

[52] U.S. Cl. ..... 5/496; 5/498

[58] Field of Search ..... 5/494, 496–500; 24/72.5

[56] References Cited

U.S. PATENT DOCUMENTS

| | | | |
|---|---|---|---|
| 2,284,778 | 6/1942 | Treiber | 5/498 |
| 2,857,643 | 10/1958 | Tomsic | 24/72.5 |
| 3,092,848 | 6/1963 | Gronvold | 24/72.5 X |
| 4,660,240 | 4/1987 | Hutton et al. | 5/498 X |
| 4,662,016 | 5/1987 | Seeman | 24/72.5 X |
| 4,698,880 | 10/1987 | Hamm | 24/72.5 |

*Primary Examiner*—Michael F. Trettel

*Attorney, Agent, or Firm*—Caesar, Rivise, Bernstein, Cohen & Pokotilow, Ltd.

[57] ABSTRACT

A grasping system (18) for use on contoured sheets (14) to keep sheets tucked and tight under mattress (10). The system comprises two independent terry elastic straps (20) having a nylon insert clip (22) attached to each end and an adjustable slide (24) on each front end (26) of the straps (20). Both straps (20) crisscross along bottom surface portion of the mattress (10).

4 Claims, 1 Drawing Sheet

GRASPING SYSTEM FOR USE WITH A CONTOURED SHEET

BACKGROUND OF THE INVENTION

The present invention relates to a grasping system for use with a contoured sheet, and more particularly, for preventing the sheet from becoming un-tucked from the mattress due to the movement of a human being either during sleeping or simply lying in bed.

A continuation of sleeping or lying in such a condition may result in wakeful nights causing restless nights and irritable moods because of having to get up in the middle of the night and tuck the sheet under the mattress by not having slept well because of the sheet moving all around you.

One way of removing the disadvantages stated above is to fix the sheet permanently on the mattress. However, it is impossible to remove the drawbacks; since it would then prevent one from replacing the sheet.

DESCRIPTION OF PRIOR ART

U.S. Pat. No. 3,092,848 issued on June 11, 1963 to G. B. Gronvold, teaches a mattress sheet holding arrangement utilizing eight tabs adjacent to fastener systems interconnected along the bottom of the mattress by means of an interconnecting band. This invention is designed to hold a novel bed sheet dimensionally restricted to the top sleeping surface of the mattress.

When the holding arrangement is in use it is visible on all sides of the mattress since the novel bed sheet does not cover the sides of the mattress. The objectives of this holding arrangement is primarily to hold novel bed sheet referred to above, thereby saving money on bed sheet material and proposed reduction of laundry bills specifically designed with hotels and hospitals in mind wherein laundry and replacement constitutes major expenses and problems. Also savings in bed making services since the novel sheet claims to wrinkle less. Furthermore, since holding arrangement is interconnected, the mattress must be completely lifted up off the box the boxspring in order to install and use. In addition, the eight fasteners make it very difficult to replace bottom sheets particularly the ones located on the top back portion of the mattress.

With regards to the Gronvold bed sheet and the assertion that a bed sheet of smaller dimension may be purchased; it is impractical since the most common and majority of sheets sold are in sets. In addition, the majority of sheets sold have contoured corners. Therefore, in this situations bed sheets to cover just the sleeping surface of the mattress would have to be a special order item.

Taking into consideration the assertion of Gronvold that a bed sheet purchased for application to a mattress has a large portion of sheet material wasted by tucking side portion of bed sheet under the mattress, is a misconception since its purpose is to cover the mattress completely over the sides so that a bed has a good appearance when made up.

Regarding the second form of holder for the Gronvold bed sheet, Gronvold teaches an elastic band applied to the corner portions of the mattress receiving the corner end of the sheet folded over into a slit in the top portion of the band causing it to grip the corner and ends of the sheet. It is a fact, however, that the band being yieldable would tend to outwardly displace itself from the mattress corner once tension and/or movement is applied on the mattress. Additionally, one would both see the bands situated on the top corner of the mattress and feel the bands situated on the bottom corners of the mattress while lying in bed. Also, one would not have a flat bed surface when bed is made up for appearance sake.

Regarding the third application of the concept of the Gronvold invention, the Gronvold patent teaches a pair of projecting fastener buttons interconnected to a yieldable strip which is interconnected to a fastener clip adjacent both to upper and lower edges of the side or end portions of a mattress cover containing a zipper element, once more using the "novel" bed sheet. Again, eight fastener elements have to be engaged making it more difficult to replace the sheets especially with the fasteners located in the back upper portion of the mattress. Additionally, this time the mattress cover and fasteners are visible on the side of the mattress. Furthermore, the majority of mattress covers these days tend to be of the contoured type other than having the zipper element which are not as common.

Furthermore, U.S. Pat. No. 4,199,831 issued on Apr. 29, 1980 to Sylvio Muller, teaches a mattress securing apparatus utilizing four right angle corner guards disposed at the corners of a mattress resting on a system having a mattress supporting surface such as a boxspring to prevent lateral displacement of the mattress relative to the boxspring.

More particularly, it consists of four corner guards each of which is maintained at the corners of the mattress by a harness assembly, which is adjustable in length and width so that the guards may be installed on any size mattress, and a cord system which flexibly connects adjacent pairs of corner guards together so as to prevent accidental dislocation of a corner guard when corner of mattress is lifted. The harness assembly comprises of three flexible bands fabricated from a material similar to the variety utilized in automotive seat belt straps.

On the other hand the present invention relates more specifically to that class of system utilized primarily to restrain the displacement of a mattress from a boxspring, and also provides the ability to keep the mattress in place when a corner of the mattress is lifted while replacing bed sheets.

OBJECTS OF THE INVENTION

Accordingly, several objects and advantages of the present invention are:

(a) to provide a grasping system for use on a contoured sheet with an independent relationship to bottom surface portion of the mattress;

(b) to provide a grasping system for use on a contoured sheet and the like which can allow easy one time installation under the bottom surface portion of the mattress;

(c) to provide a grasping system which is easy to replace sheets with;

(d) to provide a grasping system which is not seen once installed;

(e) to provide a grasping system which will provide protection against tearing the contoured sheet material and provide a stronger grip;

(f) to provide a grasping system to fit all size beds and sheets.

Still further objects and advantages of the present invention will become more apparent from a consideration of the ensuing description and drawings.

DETAILED DESCRIPTION OF THE PREFERRED EMBODIMENT

Figure 1:
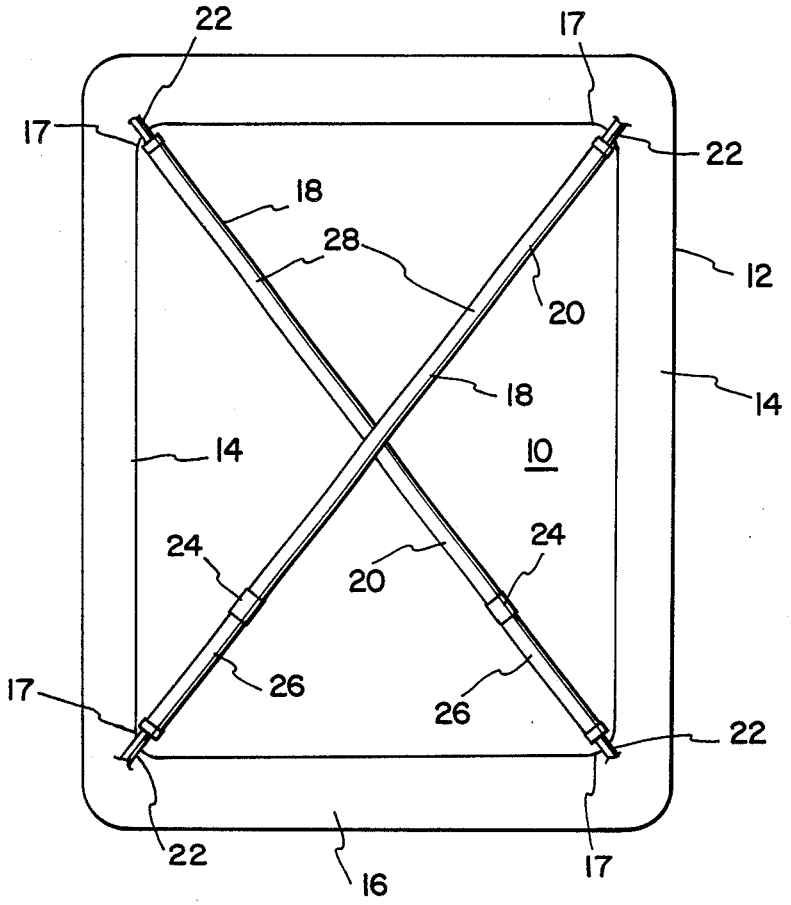
FIG. 1 is a bottom plan view which illustrates a connecting relationship between the grasping system of the present invention coming in contact with the bottom surface portion of a mattress and contoured sheet corner.

Referring to FIG. 1, there is shown an under surface portion of a mattress 10 with a contoured sheet mounted on top surface portion of mattress 12 wherein human beings lie down or sleep on. The contoured sheet 14 has a bottom portion 16 that underlies the mattress bottom portion, the bottom portion includes, opposed corner portions 17 adjacent to the mattress corners which are held by the two straps of grasping system 18, namely straps 20, each of which crisscross along bottom surface portion of mattress 10, independently of each other.

The grasping system 18 is comprised of two independent one inch wide easily slidable terry elastic straps 20 (made of 88% untucked poly and 12% rubber) with one inch nylon insert clips 22 attached at each end of each strap 20. Each strap 20 has a one inch adjustable slide 24 located along the strap 20 in a manner and placement well known to those skilled in the art. The end of the strap 20 containing the slide 24 closest to it is referred to as the adjustable front end 26 of the grasping system 18 and the opposite end of the strap 20 is referred to as the non-adjustable back end 28 of the grasping system 18.

From the foregoing description a number of advantages of the grasping system for contoured sheet of the present invention becomes evident:

(a) It will be appreciated that this form of grasping system is an effective method of holding contoured sheet tucked in tight under mattress.

(b) The use of the grasping system involves no modification of either mattress or the bed sheets most commonly used today.

(c) With the grasping system only occupying the bottom surface portion of the mattress once installed, it is not visible to the eye as well as mattress is not visible since sheet covers all side of mattress thereby giving an appearance of a well-made bed.

(d) The grasping system of the present invention requires but a one-time easy installation without having to lift the mattress off the boxspring.

(e) The nylon insert clips provide protection against tearing sheet material as well as providing a stronger grip.

(f) When replacing sheet there are only four simple clips to unhook and re-hook on the sheet corners.

(g) The grasping system of the present invention is able to adjust to any size mattress and sheet.

The manner of using the grasping system 18 as shown in FIG. 1 is as follows. Place sheet 14 on top surface of mattress 12, hook non-adjustable end 28 of grasping system's clip 22 to top corner 17 of sheet bottom portion 16, design side of clip facing down. Slide strap 20 along bottom surface of mattress 10 to opposite front corner of mattress 10 and hook adjustable front end 26 of grasping system's clip 22 to an opposed sheet corner 17. It is not necessary to lift mattress 10 since the material from which strap 20 is made slides easily in the interface between the mattress and the box spring. The foregoing procedure is repeated on opposite corners of mattress 10 using a second strap 20, of grasping system 18, thereby forming an independent crisscross with the two straps 20 along bottom surface portion of mattress 10.

When replacing sheet 14, unhook all clips 22 from sheet corners 17, replace sheet 14, re-hook all clips 22 to sheet corners 17 and adjust slides 24, if necessary.

Accordingly, it will seem that the grasping system of the present invention effectively keeps bottom sheets tucked in and tight under mattress, without modification to mattresses or sheets. Furthermore, the grasping system has additional advantages in that it permits use with any size mattress or sheet; it allows for a simple one-time installation with no lifting mattress up off the boxspring; it allows ease in replacing sheets; it provides for protection against tearing sheet material and stronger grip; it provides a solution to a very real problem with sheets today which is just accepted by human beings; it gives the appearance of a well-made bed; and it provides an effective way of holding bottom sheets tucked under mattress.

It is to be noted, that any modification and variation of the embodiments of the invention disclosed herein should not be construed as limiting the scope of the invention but as merely providing illustrations of some of the presently preferred embodiments of this invention. For example, any form, shape, design, size or color of the nylon insert clip may be utilized, as well as the terry elastic strap can have another size, color or length and the slide can have another size or color.

Without further elaboration the foregoing will so fully illustrate my invention that others may, by applying current or future knowledge, adopt the same for use under various conditions of service.

What I claim as the invention is:

1. In combination a grasping system comprising a contoured sheet, a mattress and a grasping device for firmly holding said contoured sheet to said mattress, said mattress having a top and bottom portion, sides, end portions and opposed corner portions, said contoured sheet having a bottom portion that underlies the mattress bottom portion, said bottom portion including opposed corner adjacent said mattress corner positions, said grasping device firmly holding said contoured sheet against said top, sides and corner portions of said mattress, said grasping device comprising independent, crisscrossing, adjustable first and second straps in contact with said mattress bottom and having clips at each end thereof, and wherein clips of said first strap are secured to one pair of opposed contoured sheet corner portions and wherein clips of said second strap are secured to another pair of opposed contoured sheet corner portions whereby the contoured sheet is held tightly against the top and sides of said mattress.

2. A grasping system as defined in claim 1 further including a boxspring positioned beneath said mattress, wherein there is an easy one-time installation provided without having to lift the mattress up off the boxspring due to the independent straps.

3. A grasping system as defined in claim 1, wherein protection against tearing of the bottom sheet and better grip is achieved with the securement of nylon insert clips to ends of said adjustable straps.

4. A grasping system as defined in claim 1, wherein said straps are terry elastic straps, each strap having an adjustable slide to be placed along the bottom surface portion of the the mattress and are used to conform to mattress size and sheet.

* * * * *